United States Patent [19]

Greenfield

[11] 4,389,074

[45] Jun. 21, 1983

[54] MINE TOOLS UTILIZING COPPER-MANGANESE NICKEL BRAZING ALLOYS

[75] Inventor: Mark S. Greenfield, Henderson, Ky.

[73] Assignee: GTE Products Corporation, Stamford, Conn.

[21] Appl. No.: 322,607

[22] Filed: Nov. 18, 1981

Related U.S. Application Data

[63] Continuation of Ser. No. 171,578, Jul. 23, 1980, abandoned.

[51] Int. Cl.[3] ..... E21B 10/00

[52] U.S. Cl. ..... 299/79; 175/410; 228/122; 228/263 A

[58] Field of Search ..... 228/122, 263 A; 175/410, 411, 418; 299/79

[56] References Cited

U.S. PATENT DOCUMENTS

| | | | |
|---|---|---|---|
| 3,198,609 | 8/1965 | Cape | 228/263 D |
| 3,279,049 | 10/1966 | Ellis et al. | 228/221 |
| 3,296,693 | 1/1967 | Carter | 228/248 |
| 3,444,613 | 5/1969 | Foerster | 228/263 A |

FOREIGN PATENT DOCUMENTS

| | | | |
|---|---|---|---|
| 503496 | 9/1979 | Australia . | |
| 1939890 | 6/1971 | Fed. Rep. of Germany | 228/122 |
| 2311400 | 12/1974 | Fed. Rep. of Germany | 228/122 |

*Primary Examiner*—Kenneth J. Ramsey
*Attorney, Agent, or Firm*—Donald R. Castle

[57] ABSTRACT

A mine tool having an improved braze strength consists of a ferrous metal body and a cemented carbide insert brazed to the body with a brazing alloy of 40% to 70% copper, 25 to 45% manganese and 5 to 15% nickel.

5 Claims, 1 Drawing Figure

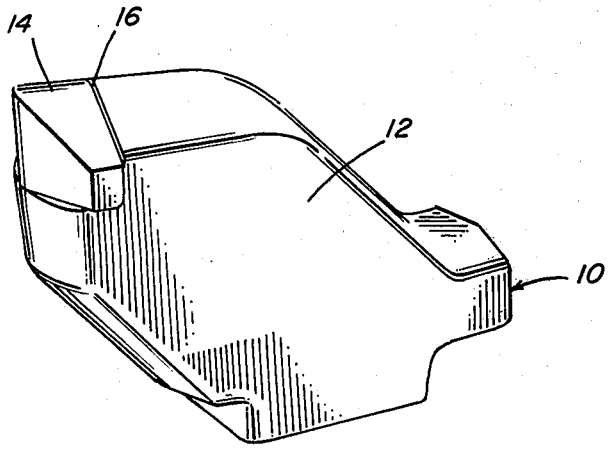
14
16
12
10

MINE TOOLS UTILIZING COPPER-MANGANESE NICKEL BRAZING ALLOYS

This is a continuation of application Ser. No. 171,578, filed July 23, 1980, now abandoned.

BACKGROUND OF THE INVENTION

Mining tools generally comprise a body of a ferrous metal alloy, such as steel, having a cemented carbide insert brazed into a recess in the body. A brazing alloy for this use should ideally possess the ability to wet both the body material and the cobalt-bonded tungsten carbide (the cutting tip insert material) as well as being metallurgically compatible with these materials. A brazing alloy should also possess adequate plasticity in a temperature range from about 300° C. and its melting point. Suitable brazing alloys should also have a sufficiently low solidus temperature in combination with its plasticity so that a relatively low stress braze joint is formed, hence a solidus temperature below about 900° C. is preferred. In addition to the foregoing properties the braze should form a joint between the insert and the body having a shear strength exceeding 38,000 pounds per square inch at room temperature to prevent the premature failure of the brazed joint between the body and the insert.

Heretofore silver-base brazing alloys have been used in mine tools to braze the insert to the body of the mine tool. While these alloys can exhibit minimum bonding strength, sufficient plasicity and desirable brazing temperatures they are expensive and some failure of joints occurs. They are also sensitive to carbide surface chemistry. Non-silver base alloys such as copper base alloys containing 10–45% by weight of zinc, minor amounts of manganese, cobalt and silicon such as disclosed in Australian Pat. No. 503,496 do not appreciably increase the bond strength of the brazed joint. It has been found that joints produced with these alloys vary considerably in strength as a function of carbide surface chemistry. Literature indicates that both surface carbon and cobalt levels significantly effect the wetability of the carbide. It is presently common practice to try to control carbide surface chemistry with various mechanical and thermal treatments.

It is believed, therefore, that a mine tool having a ferrous metal body with an insert brazed into a recess in the body when the braze exhibits from about 15% to about 20% greater braze strength than similar tools containing a silver base braze is an unexpected advancement in the art. It has also been discovered that this alloy is relatively insensitive to carbide surface chemistry, providing a consistantly high quality braze joint.

SUMMARY OF THE INVENTION

In accordance with one aspect of this invention there is provided a mine tool having a ferrous alloy body having a recess therein, a cemented carbide insert within the recess and brazed to the body with a braze consisting essentially of from 40% to 70% by weight of copper, from about 25% to 45% by weight of manganese and from about 5% to 15% nickel having a solidus temperature of from about 850° C. to about 900° C. and a liquidus temperature of less than about 930° C.

BRIEF DESCRIPTION OF THE DRAWINGS

FIG. 1 is an isometric view of a typical mine tool of this invention.

DETAILS OF THE PREFERRED EMBODIMENTS

For a better understanding of the present invention, together with other and further objects, advantages and capabilities thereof, reference is made to the following disclosure and appended claims in connection with the above described drawings.

The bit body, carbide insert and filler metal are prepared for brazing in such a manner as to avoid contamination of the joint with oil, dirt, etc. The braze surfaces are coated with a high temperature brazing flux which should remain active to at least 1100° C. The joint is assembled by placing a braze preform between the surfaces to be joined. The parts are heated by induction until flow of the filler metal occurs. Joint temperatures of about 1000° C. are required. Heating times of about 15 seconds are used. A joint thickness of about 0.003" is formed.

As previously mentioned the brazing alloys useful in the practice of this invention are copper base alloys consisting of from about 40% to 70% by weight of copper, from about 25% to about 45% by weight of manganese and from about 5% about 15% by weight of nickel. Preferred are brazes consisting essentially of from about 50% to 55% by weight of copper, from about 35% to 40% by weight of manganese and from about 5% to about 15% nickel. Especially preferred is a brazing alloy sold under the trade name of Nicuman 37 by the Wesgo Division of GTE Products Corporation. The nominal composition of that alloy is 52.5% by weight of copper, 38% by weight of manganese and 9.5% of nickel. In addition to the foregoing metallic compositional limits, the alloy should have a solidus temperature of from about 850° C. and 900° C. Nicuman 37 previously mentioned has a solidus temperature of about 880° C. and a liquidus temperature of about 925° C.

With particular reference to FIG. 1 there is shown a typical mine tool of the present invention. The mine tool 10 comprises a steel body 12, a cemented tungsten carbide insert 14 and a brazed joint 16. In the embodiment shown, the body 12 is steel, the cement carbide insert 14 is a composition containing about 90% by weight of tungsten carbide and about 10% by weight of cobalt and has a tungsten grain size of from about 1 to about 4 microns. The braze joint 16 is made by employing a thin preform of a copper base brazing alloy as previously described. Although the mine tool shown is only one example of a mine tool, mine tools of other configuration can be produced in accordance with the practice of this invention if the body is a ferrous metal and a carbide insert is utilized. Such other designs are well-known to those skilled in the mine tool art.

While the process disclosed herein for the type of mine tool illustrated induction heating is preferred because of its adaptability to automation, other types of heating can be used such as furnace heating, electrical heating and the like. The exact parameters of time of heating will vary depending upon the size of the carbide insert which correlates directly to the volume of brazing alloy that has to be melted and the surface areas of the carbide insert and the ferrous alloy body that have to be wetted.

EXAMPLE 1

At least six each of braze samples mine tools of the configuration shown in FIG. 1 were fabricated. The alloy compositions shown in Table I below were used to braze cemented carbides inserts into the steel bodies. The completed mine tools were identical except for the braze used. After completion the tools were subjected to shear tests and the results are reported in Table II.

The shear test is conducted using methods described in the British National Coal Board Specification No. 541/1969. The test involves rigidly fixturing the bit body so that a load can be applied to the side of the tip adjacent to the braze. The force required to push off the carbide is measured and a shear strength is then calculated based on braze area.

TABLE I

| | COMPOSITION | | | | | | | |
|---|---|---|---|---|---|---|---|---|
| Braze | Ag | Co | Cu | Mn | Ni | Zn | Si | P |
| 1 | 40 | | 30 | | 5 | 25 | — | — |
| 2 | | | 52.5 | 38 | 9.5 | — | — | — |
| 3 | 25 | | 38 | 2 | 2 | 33 | — | — |
| 4 | 5 | | 57 | 2 | 2 | 34 | — | — |
| 5 | | 2 | 57.5 | 2 | | 38.5 | — | — |
| 6 | | | 48.58 | | 10.25 | 41 | .15 | .02 |
| 7 | 49 | | 16 | 7.5 | 4.5 | 23 | — | — |

TABLE II

| Braze | Average Shear Strength (#/in$^2$) | Relative Strength |
|---|---|---|
| 1 | 33,906 | 100 |
| 2 | 39,295 | 115.9 |
| 3 | 29,263 | 86.3 |
| 4 | 28,421 | 83.8 |
| 5 | 29,392 | 86.7 |
| 6 | 28,512 | 84.1 |

TABLE II-continued

| Braze | Average Shear Strength (#/in$^2$) | Relative Strength |
|---|---|---|
| 7 | 35,492 | 104.7 |

While there has been shown and described what are at present considered the preferred embodiments of the invention, it will be obvious to those skilled in the art that various changes and modifications may be made therein without departing from the scope of the invention as defined by the appended claims.

What is claimed is:

1. A mine tool comprising a ferrous metal body having a recess and a cemented carbide insert within said recess brazed to said body by a brazing alloy consisting essentially of from about 40% to about 70% by weight of copper, from about 25% to about 45% by weight of manganese and from about 5% to about 15% by weight of nickel, wherein said brazing alloy has a solidus temperature of from about 850° C. to about 900° C. and a liquidus temperature of less than about 930° C., said insert and said alloy filling said recess, said mine tool being designed for operation under conditions wherein the brazed joint is subjected to conditions of high shear.

2. A mine tool according to claim 1 wherein said brazing alloy consisting essentially of from about 50% to about 55% by weight of copper, from about 35% to about 40% by weight of manganese and balance nickel.

3. A mine tool according to claim 2 wherein said body is steel.

4. A mine tool according to claim 3 wherein said insert is a cemented tungsten carbide insert.

5. A mine tool according to claim 4 wherein said alloy consists essentially of about 52.5% by weight copper, about 38% by weight manganese and about 9.5% by weight nickel.

* * * * *

US004389074B1

REEXAMINATION CERTIFICATE (2081st)

United States Patent [19]

Greenfield

[11] B1 4,389,074

[45] Certificate Issued Sep. 7, 1993

[54] MINE TOOLS UTILIZING COPPER MAGANESE NICKEL BRAZING ALLOY

[75] Inventor: Mark S. Greenfield, Henderson, Ky.

[73] Assignee: GTE Products Corp., Danvers, Mass.

Reexamination Requests:

No. 90/001,089, Sep. 17, 1986
No. 90/001,217, Apr. 13, 1987
No. 90/001,308, Aug. 13, 1987
No. 90/001,900, Dec. 6, 1989

Reexamination Certificate for:

| | |
|---|---|
| Patent No.: | **4,389,074** |
| Issued: | **Jun. 21, 1983** |
| Appl. No.: | **322,607** |
| Filed: | **Nov. 18, 1981** |

Related U.S. Application Data

[63] Continuation of Ser. No. 171,578, Jul. 23, 1980, abandoned.

[51] Int. Cl.[5] ..... E21B 10/00

[52] U.S. Cl. ..... 299/79; 175/427; 175/435; 228/122

[58] Field of Search ..... 228/122, 124, 263.12; 299/79; 175/410, 427, 435

[56] References Cited

U.S. PATENT DOCUMENTS

| | | | |
|---|---|---|---|
| 2,302,069 | 11/1942 | Stephens . | |
| 3,021,124 | 2/1962 | Bowen . | |
| 3,165,822 | 1/1965 | Beeghley . | |
| 3,198,609 | 8/1965 | Cape | 228/263.15 X |
| 3,239,275 | 3/1966 | Belugou . | |
| 3,264,186 | 12/1966 | Buell | 175/410 |
| 3,279,049 | 10/1966 | Ellis et al. | 228/221 |
| 3,296,693 | 1/1967 | Carter | 228/248 |
| 3,444,613 | 5/1969 | Foerster | 228/263.12 X |
| 4,049,434 | 7/1977 | Sloboda . | |
| 4,101,318 | 7/1978 | Rudy | 75/240 |
| 4,219,239 | 8/1980 | Weikert et al. . | |
| 4,340,650 | 7/1982 | Pattanaik et al. | 228/263.12 X |
| 4,497,520 | 2/1985 | Wanen . | |

FOREIGN PATENT DOCUMENTS

| | | |
|---|---|---|
| 503496 | 9/1979 | Australia . |
| 764815 | 4/1954 | Fed. Rep. of Germany . |
| 1939890 | 6/1971 | Fed. Rep. of Germany . |
| 2311400 | 12/1974 | Fed. Rep. of Germany . |

OTHER PUBLICATIONS

Handy & Harman Publication entitled "Application Data Sheet Carbide to Metal Bonding/Brazing Carbide Tool Tips" (1967) [Exhibit Q].

Handy & Harman Publication entitled "Application Data Sheet Number 74-1 Carbide to Metal Bonding" (1974) [Exhibit S].

Handy & Harman Publication entitled "Technical Data Sheet Number D-61" (1970) [Exhibit W].

"NICUMAN 37" Publication published by GTE Wesgo and attached as Exhibit D to the Brief (date unknown).

"Brazing Procedure NICUMAN 37" Publication published by GTE Wesgo and attached as Exhibit E to the Brief (date unknown).

"CLADBRAZE 37" Published by GTE Wesgo and attached as Exhibit F to the Brief (date unknown).

Beron, A. F., et al., Coal Cutting, State Scientific & Tech. Pub. House for Mining Literature, 1962, pp. 100-101.

Yatskitch, V. G. et al., Mining Machines and Equipment Complexes, 4th Ed. Moscow Nedra 1974, pp. 28-31.

Kennametal Mining Catalog M-4, 1947.

Kennametal Mining Tools for Cutting and Drilling Catalog M-6, 1950.

Kennametal Mining Tools Catalog M-11 and Supplement No. 1, 1965.

British Coal Specification 718:1988 published by British Coal, P.O. Box 59, Doncaster, So. Yorkshire (1988).

Shute *Cemented-Carbide Tools* The Machinery Publishing Co., London, N.W.I. pp. 41-46 (1949).

Doyle, Manufacturing Processes and Materials for Engineers, 1961, 1969, pp. 446-448.

(List continued on next page.)

*Primary Examiner*—Kenneth J. Ramsey

[57] ABSTRACT

A mine tool having an improved braze strength consists of a ferrous metal body and a cemented carbide insert brazed to the body with a brazing alloy of 40% to 70% copper, 25 to 45% manganese and 5 to 15% nickel.

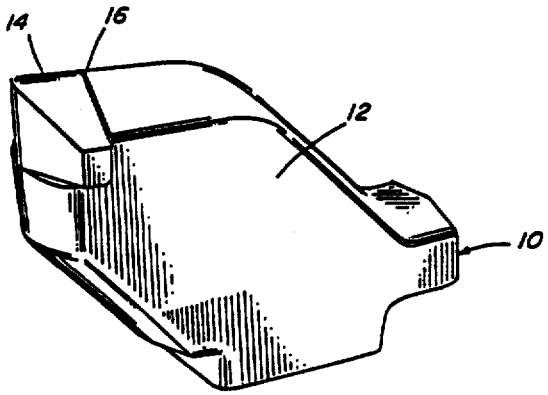

OTHER PUBLICATIONS

K. G. Stjernberg, U. Fisher, N. I. Hugoson, "Wear Mechanisms Due to Different Rock Drilling Conditions", (1975).

Sylvania Mining Tools Brochure (date unknown).

AMS-4764 Specification (1966) [Exhibit U-1].

AMS-4764A Specification (1978) [Exhibit U].

Webster's New Collegiate Dictionary, G & C Merriam Co. 1977 p. 378.

Kennametal Brochure entitled "Designing With Kennametal" (date unknown).

Baker *Carbide Cutting Tools* American Technical Society, Chicago, Ill. 1949, pp. 66, 69, 78-81.

Handy and Harman publication entitled "Brazing Carbide Tool Tips" (1974).

Handy and Harman publication entitled "Brazing Carbide Tool Tips" (1967).

S. C. Bailey and C. M. Perrott, "Wear Processes Exhibited by Wc-Co Rotary Cutters in Mining", (1974).

J. Larson-Basse "Wear of Hard-Metals In Rock Drilling: A Survey of the Literature" (1973).

H. J. Osburn, "Wear of Rock Cutting Tools" (1969).

A. Latin, "Properties of Tungsten Carbide-Cobalt Alloys Used for Mineral Cutting Tools" (1961).

Carboloy catalog "Mining Tools" dated Sep. 1, 1977.

Vermeer catalog "Vermeer Stump Cutters" (date unknown).

Vermeer catalog "Vermeer cutters and Teeth" (date unknown).

Handy & Harman publication "Brazing Carbide Tool Tips" No. 74-1, 1974.

Handy & Harman publication "Brazing Carbide Tool Tips" (date unknown).

British National Coal Board Specification No. 544/1977.

"Brazing Manual," American Welding Society, Inc., 550 N.W. 42nd Ave., Miami, Fla. 33216, 1976.

"Joining Ceramics to Metals and Other Materials," WRC Bulletin No. 178, Nov. 1972.

Gillian and Adams, "Improved Brazing Methods for Tungsten Carbide Tool Bits," Supplement to Welding Journal, Jul. 1971, pp. 267-271.

Roberts, "Some Copper-Brace Brazing Alloys and Their Uses," Welding and Metal Fabrication, Jan. 1974, pp. 14-20.

"The Brazing Book," Handy & Harmon, 850 Third Ave., New York, N.Y. 10022, 1977.

"Brazing Technical Bulletin, No. T-2," Handy & Harmon, 850 Third Ave., New York, N.Y. 10022, 1979.

"Brazing Technical Bulletin, No. T-5," Handy & Harmon, 850 Third Ave., New York, N.Y. 10022, 1979.

"Brazing Technical Bulletin, No. T-7," Handy & Harmon, 850 Third Ave., New York, N.Y. 10022, 1979.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 through 5 are cancelled.

New claims 6 and 7 are added and determined to be patentable.

*6. A mine tool comprising a ferrous steel body having a recess and a cobalt bonded cemented tungsten carbide insert within said recess brazed to said body by a brazing alloy, said brazing alloy consists essentially of about 52.5% by weight copper, about 38% by weight manganese and about 9.5% by weight nickel, wherein said brazing alloy has a solidus temperature of from about 850° C. to about 900° C. and a liquidus temperature of less than about 930° C., said insert and said alloy filling said recess, said mine tool being designed for operation under conditions wherein the brazed joint is subjected to conditions of high shear, said brazed joint being a relatively low stress braze joint having a shear strength exceeding 38,000 pounds per square inch at room temperature to prevent the premature failure of the braze joint between said insert and said body wherein said mine tool has the configuration when viewed in one direction shown in the drawing.*

*7. A mine tool for mining a material comprising a ferrous steel body having a recess and a cobalt bonded cemented tungsten carbide insert comprising about 90% by weight tungsten carbide and having a grain size of from about 1 to about 4 microns within said recess brazed to said body by a brazing alloy, said insert and said brazing alloy filling said recess and said insert having a side surface adjacent said braze, said brazing alloy consists essentially of about 52.5% by weight copper, about 38% by weight manganese and about 9.5% by weight nickel, wherein said brazing alloy has a solidus temperature of from about 850° C. to about 900° C. and a liquidus temperature of less than about 930° C., said mine tool being designed for operation under conditions wherein the brazed joint is subjected to conditions of high shear during mining wherein said mine tool has the configuration when viewed in one direction shown in the drawing.*

* * * * *